United States Patent [19]

Reiter

[11] 4,190,152

[45] Feb. 26, 1980

[54] MUSICAL INSTRUMENT CARRYING CASE

[76] Inventor: Richard L. Reiter, 36 Catherine Ct., Cedar Grove, N.J. 07009

[21] Appl. No.: 15,846

[22] Filed: Feb. 27, 1979

[51] Int. Cl.[2] ..... A45C 11/00

[52] U.S. Cl. ..... 206/314; 248/505

[58] Field of Search ..... 206/314, 14; 248/505, 248/507, 509; 84/385 R

[56] References Cited

U.S. PATENT DOCUMENTS

| | | | |
|---|---|---|---|
| D. 225,033 | 10/1972 | Hyman | D3/30 |
| 1,352,814 | 9/1920 | Kirk | 206/314 |
| 1,541,895 | 6/1925 | Blair | 206/14 |
| 1,664,476 | 4/1928 | Geib | 206/314 |
| 1,900,718 | 3/1933 | Lang | 206/314 |
| 1,988,718 | 1/1935 | Cook | 206/314 |
| 2,792,932 | 5/1957 | Freistat | 206/314 |
| 3,047,704 | 7/1962 | Van Noy | 248/505 |

FOREIGN PATENT DOCUMENTS

| | | | |
|---|---|---|---|
| 435031 | 12/1911 | France | 206/14 |
| 152482 | 10/1920 | United Kingdom | 206/14 |

*Primary Examiner*—Herbert F. Ross
*Attorney, Agent, or Firm*—Lawrence I. Field

[57] ABSTRACT

A carrying case for musical instruments, particularly saxophones, in which means are provided for immobilizing the instrument so that it does not shift its position within the case regardless of whether the case is right side up, upside down or on its side.

9 Claims, 5 Drawing Figures

MUSICAL INSTRUMENT CARRYING CASE

This invention relates to a carrying case for saxophones and particularly to a case in which saxophones may be carried from place to place. More specifically the invention consists in modifying existing instrument cases so that the instrument is prevented from shifting relative to the case whereby damage to the instrument due to such shifting is avoided.

Instrument cases for saxophones are usually of one of three different types. One case commonly known as a gig bag consists of a flexible sack made of leather or other waterproof material which protects the instrument from rain, snow, and other adverse atmospheric elements but which affords no protection against collisions with objects, or falls on hard surfaces.

A second type of case is a rectangular case such as the trumpet cases shown in Geib U.S. Pat. No. 1,664,476 and Freistat U.S. Pat. No. 2,792,932 in which the floor of the case is molded to receive the cornet or trumpet whereby the instrument is restrained from some movement, but is not totally immobilized. Some cases of this type are provided with molded inserts which are adapted to conform to the shape of the instrument they are to receive, but the configuration of the cavity is usually oversized to be certain that all sizes are accomodated. As a result the instrument is always free to move inside the case to some extent.

Still another known case, such as the one shown in U.S. Pat. No. Des. 225,033 consists of two halves of hard plastic shaped like a saxophone and which may be connected by a hinge or other means and which are constructed of material configured to define a cavity to receive the instrument and have relatively flat top and bottom surfaces. Possibly because of the differences in size of various saxophones there is always extra space in the case which permits the instrument to move to some extent in the case, with consequent risk of damage to one or more parts of the instrument, for instance the keys or the bell.

The saxophone case of the present invention differs from these and other prior art cases by providing specific unique means which totally immobilize the instrument while it is stored in the case even when it is held upside down, and which thereby prevents damage to the body or the keywork (pads, rods, keys, etc.) of the saxophone. One such means hereinafter described is located in the crook of the saxophone and another such means is located at the top of the saxophone. Preferably both means are utilized to achieve the objects of the invention. The invention will be better understood from the description which follows taken with the drawings in which:

Figure 1:
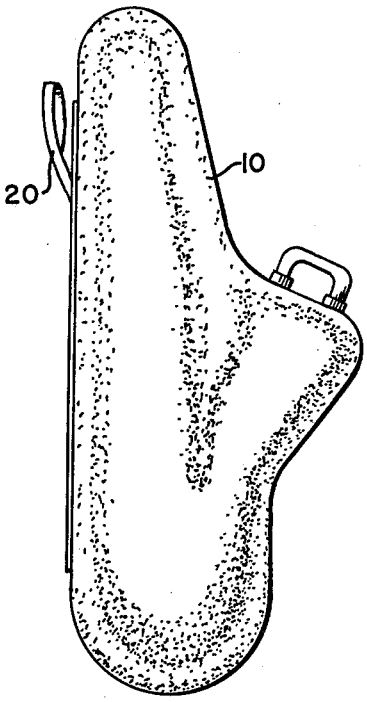
FIG. 1 is a plan view showing the top or bottom of the case.
Figure 2:
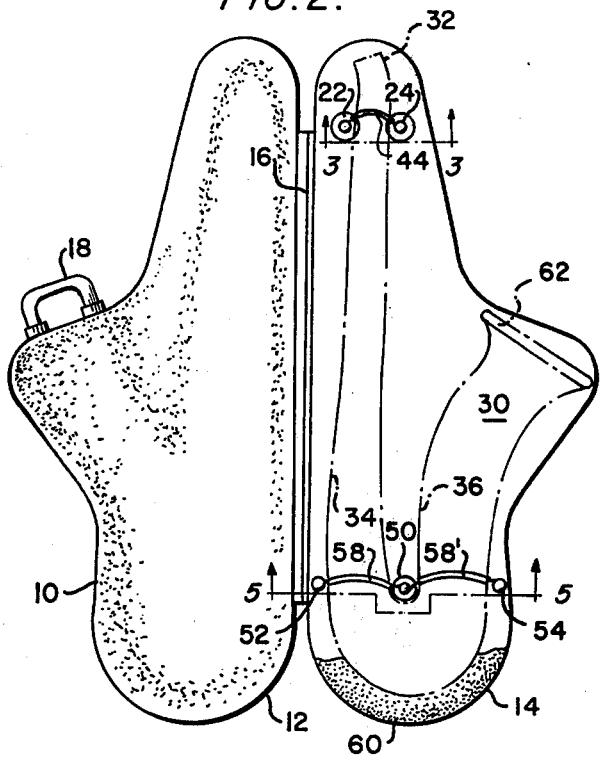
FIG. 2 is a view showing the open case with an instrument stored therein.

As seen most clearly in FIGS. 1 and 2 the instrument carrying case 10 of this invention comprises two halves 12, 14 joined along one side by a hinge 16. One half of the case may include a handle 18 and a strap 20 may be attached to any convenient location to facilitate storage of the case on a hook. A zipper (not shown) or other latches (not shown) may be provided to close the case. All of the foregoing are conventional and are shown, for example in U.S. Pat. No. Des. 225,033. The present invention is applicable not only to that carrying case which has a rigid flat bottom is also applicable to other carrying cases wherein a saxophone is to be stored in a rigid shell which has been molded to receive the saxophone.

Figure 3:
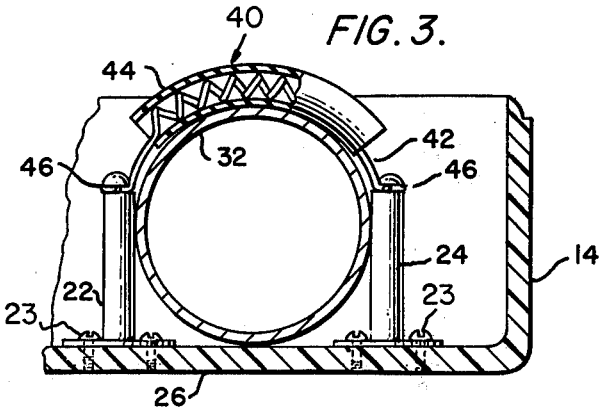
FIG. 3 is an enlarged view of part of the case as seen from plane 3—3 of FIG. 2
Figure 4:
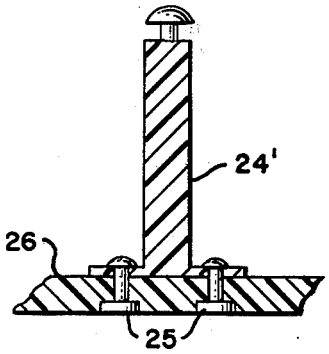
FIG. 4 is a similar view of a modification of FIG. 3.
Figure 5:
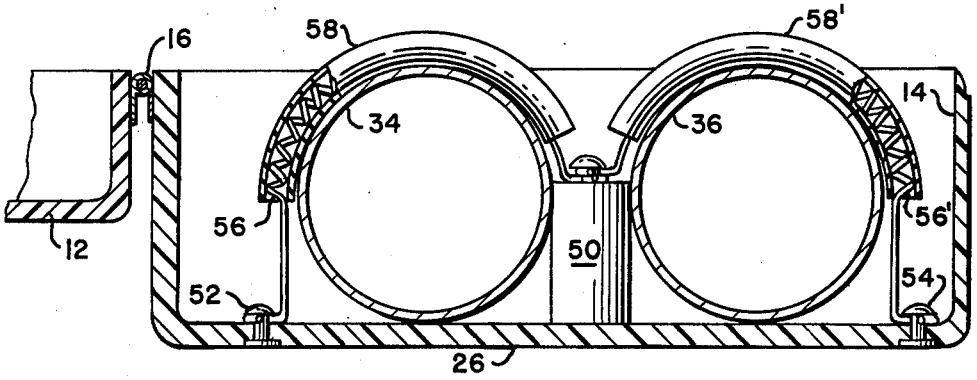
FIG. 5 is an enlarged view of the case as seen from plane 5—5 of FIG. 2.

The saxophone immobilizing means of this invention comprises the means best seen in FIGS. 3, 4 and 5. For the purpose of holding the top of the saxophone in place, two vertical braces 22, 24 are attached to the floor 26 of half 14. As shown in FIGS. 3 and 4 the braces 22 and 24 may be in the form of angles, or posts, and are firmly attached to the floor of the case, e.g. by being screwed into the floor by screws 23 or by other means such as an adhesive. Preferably braces 22 and 24 are spaced so that there is virtually no clearance between the top 32 of saxophone 30 and the two braces 22 and 24 whereby the top of the saxophone is prevented from side to side movement along floor 26. To prevent movement of the top 30 in an up and down direction relative to floor 26, a flexible restraint 40 is provided as shown in FIG. 3. Restraint 40 may comprise a spring 42 partly enveloped in a piece of rubber tubing 44, the two ends 46 of the spring being secured either to braces 22, 24 or directly to floor 26, in order to keep the top 30 of the saxophone resting on floor 26. One end of spring 42 may be secured to the floor and one to a brace or both ends may be secured to the floor 26. The spring may be hooked around a brace or it may be hooked into a hole (not shown) provided for the purpose in a brace. Instead of metal spring 42, a band of other elastic material, e.g. rubber may be used to keep the top end of the saxophone firmly on floor 26.

The other restraining means comprising my invention is shown in FIG. 5 and includes a post 50 secured to floor 26 at a position where it will be in the crook between the main body 34 and the bell 36 of the saxophone 30, thereby preventing forward movement of the saxophone.

Extending between post 50 and floor 26 is a spring 56 extending over top 34 of the saxophone. Spring 56 may be enveloped in a rubber tube 58 or spring 56 may be in direct contact with the saxophone. A similar restraint around bell 36 extends from post 50 to floor 26 comprising spring 56' and hose 58'. The springs 56, 56' or equivalent structure pin the bottom of the saxophone to the floor 26 in the same manner as spring 42 pins the top of the saxophone to the floor 26. By making the springs of an appropriate length and of an appropriate strength and by positioning dowel 50 at the crook, saxophone 30 is held immobilized in case 10, even when the case is inadvertently opened while the bottom is uppermost. Post 50 may be a wooden dowel or other material, and should be spaced so that forward and lateral movement of the saxophone cannot take place to any significant extent. With a tenor saxophone dowling $\frac{3}{4}$ inches in diameter and $2\frac{1}{2}$ inches high has successfully been used.

The saxophone 30 may rest on a molded pad (not shown) which may be made of foam and which is adapted to resiliently support the saxophone and to cushion the same when the case is placed on a supporting surface (bench or floor).

An additional pad 60 (FIG. 2) may be provided at the lower case 14 so as to insure that damage to the bottom of the saxophone does not take place and to prevent rearward movement of the saxophone.

FIG. 4 shows a modification of the manner in which brace 22 may be secured to the floor 26 by means of rivets 25.

The saxophone case may be modified by the provision of the restraining means shown in FIG. 5 which prevent forward, lateral and up and down movement of the saxophone, or if this is not sufficient, both the means of FIGS. 5 and 3 may be provided, or it is possible that post 50 and the means shown in FIG. 3 may suffice to immobilize the saxophone.

It will be evident that other size dowels may be used depending on the type of saxophone which is to be stored, soprano, alto, tenor, bass, etc. and that the placement of such braces, whether they are posts, dowels, angles or other means will be in conformity with the specific shape of the saxophone 30 to be stored in the case 10.

Having now described a preferred embodiment of the invention it is not intended that it be limited except as may be required by the appended claims.

I claim:

1. In a carrying case for storing and carrying a saxophone or similarly shaped musical instrument, said case including a floor and a cover portion; improved means for preventing said instrument from moving while in said case and for holding said instrument firmly in engagement with the floor of said case comprising:

a post extending upwardly from the floor of said case and located in the crook of said saxophone between the main body and the bell thereof;

resilient means secured to said post and to said floor and extending over said main body and holding the same firmly to the floor preventing movement thereof; and further resilient means secured to said post and to said floor and extending over said bell and holding the same firmly to the floor preventing movement thereof.

2. The case of claim 1 wherein each said resilient means is a spring.

3. The case of claim 2 wherein a portion of each said spring extending over said instrument is encased in a tube of soft material.

4. In the carrying case of claim 1 for storing and carrying a saxophone or similarly shaped musical instrument, said case including a floor and a cover portion; further improved means for preventing said instrument from moving while in said case and for holding said instrument firmly in engagement with the floor of said case comprising:

a pair of braces extending upwardly from said floor and secured thereto, said braces being located adjacent the top end of the main body of said instrument and being spaced relative to one another to define a space therebetween into which said top end is snugly received, thereby preventing said instrument from shifting laterally; and resilient means engaging the upper surface of said top end and holding the same securely on the floor of said case.

5. The case of claim 4 wherein each said resilient means is a spring.

6. The case of claim 5 wherein at least one end of said spring engaging said top end is secured to one of said braces.

7. The case of claim 6 wherein at least one end of said spring engaging said top end is secured to the floor of said case.

8. The case of claim 7 wherein both ends of said spring engaging said top end are secured to said braces.

9. The case of claim 5 wherein both ends of said spring are secured to the floor of said case.

* * * * *